US011408439B2

(12) United States Patent
Higashimori et al.

(10) Patent No.: US 11,408,439 B2
(45) Date of Patent: Aug. 9, 2022

(54) CENTRIFUGAL COMPRESSOR AND TURBOCHARGER

(71) Applicant: MITSUBISHI HEAVY INDUSTRIES ENGINE & TURBOCHARGER, LTD., Sagamihara (JP)

(72) Inventors: Hirotaka Higashimori, Tokyo (JP); Tadashi Kanzaka, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 98 days.

(21) Appl. No.: 16/482,046

(22) PCT Filed: Mar. 28, 2017

(86) PCT No.: PCT/JP2017/012687
§ 371 (c)(1),
(2) Date: Jul. 30, 2019

(87) PCT Pub. No.: WO2018/179100
PCT Pub. Date: Oct. 4, 2018

(65) Prior Publication Data
US 2020/0063753 A1 Feb. 27, 2020

(51) Int. Cl.
*F04D 29/44* (2006.01)
*F04D 29/28* (2006.01)
(Continued)

(52) U.S. Cl.
CPC ..... *F04D 29/441* (2013.01); *F04D 17/10* (2013.01); *F04D 29/284* (2013.01);
(Continued)

(58) Field of Classification Search
CPC ..... F04D 29/284; F04D 29/44; F04D 29/441; F04D 29/445
See application file for complete search history.

(56) References Cited

U.S. PATENT DOCUMENTS 2,471,174 A * 5/1949 Trumpler ..... F04D 29/30 415/58.6
3,289,921 A 12/1966 Soo et al.
(Continued)

FOREIGN PATENT DOCUMENTS

EP 0341553 A * 11/1989 ..... F04D 29/44
JP 53-147115 A 12/1978
(Continued)

OTHER PUBLICATIONS

Written Opinion of the International Searching Authority, dated Jun. 13, 2017, for International Application No. PCT/JP2017/012687, with an English translation.

*Primary Examiner* — Christopher R Legendre
(74) *Attorney, Agent, or Firm* — Birch, Stewart, Kolasch & Birch, LLP

(57) ABSTRACT

A centrifugal compressor 10 includes a diffuser 13 that comprises: a shroud wall surface 131 that extends in the radial direction of a rotating shaft 3; and a hub wall surface 132 that extends in the radial direction and opposes the shroud wall surface 131 on the downstream side of a flow in the axial direction of the rotating shaft 3, the hub wall surface having a gap between itself and the shroud wall surface 131, and with that gap, forming an annular diffuser flow path 130 through which a fluid flows. A hub-side convex portion **132*b* is formed over the entire periphery of the hub wall surface 132, the hub-side convex portion 132*b* protruding toward the shroud wall surface 131 side relative to a straight line L1 that connects a starting end 132*s* on an inlet 130*a* side of the diffuser flow path 130 and a terminating end 132*e* on an outlet 130*b* side of the diffuser flow path 130**.

18 Claims, 9 Drawing Sheets

(51) Int. Cl.
*F04D 17/10* (2006.01)
*F04D 29/42* (2006.01)

(52) U.S. Cl.
CPC ..... *F04D 29/4213* (2013.01); *F04D 29/445* (2013.01); *F05D 2220/40* (2013.01); *F05D 2250/52* (2013.01); *F05D 2250/711* (2013.01); *F05D 2250/712* (2013.01)

(56) References Cited

U.S. PATENT DOCUMENTS

| | | | | |
|---|---|---|---|---|
| 2009/0060731 | A1* | 3/2009 | Chen | F04D 29/441 415/204 |
| 2010/0129209 | A1 | 5/2010 | Sugimoto et al. | |
| 2015/0132120 | A1* | 5/2015 | Yoeda | F01D 9/026 415/204 |
| 2020/0063753 | A1* | 2/2020 | Higashimori | F04D 29/44 |

FOREIGN PATENT DOCUMENTS

| | | | |
|---|---|---|---|
| JP | 54-161007 | U | 11/1979 |
| JP | 10-176699 | A | 6/1998 |
| JP | 2008-75536 | A | 4/2008 |
| JP | 2008-510100 | A | 4/2008 |
| JP | 5050511 | B2 | 10/2012 |

* cited by examiner

CENTRIFUGAL COMPRESSOR AND TURBOCHARGER

TECHNICAL FIELD

The present invention relates to a centrifugal compressor and a turbocharger.

BACKGROUND ART

Known in the related art are techniques relating to a centrifugal compressor and a turbocharger provided with the centrifugal compressor boosting a fluid by impeller rotation and compressing the boosted fluid by decelerating the fluid with a diffuser and performing dynamic-to-static pressure conversion. For example, PTL 1 discloses a structure in which a diffuser surface disposed on the axially upstream side of an impeller is divided into a converging section and a diverging section in a compressor impeller housing for a turbocharger compressor impeller. In this structure, the diverging section reduces wall friction while the converging section forms a uniform flow so that the flow can be stabilized and the efficiency of the diffuser can be improved.

CITATION LIST

Patent Literature

[PTL 1] PCT Japanese Translation Patent Publication No. 2008-510100

SUMMARY OF INVENTION

Technical Problem

In the diffuser of the centrifugal compressor according to the related art, a reverse flow may occur at the boundary layer of the flow on a hub wall surface side, which is a part of the wall surface that forms a diffuser flow path and is disposed on the axially downstream side. This is because the circumferential velocity of the flow is lower (that is, the centrifugal force of the flow is smaller) on the hub wall surface side than on a shroud wall surface side disposed on the axially upstream side and it may become impossible to resist the force that acts radially inward relative to the fluid in the diffuser flow path. The reverse flow is likely to occur at a low flow rate in particular.

Once a reverse flow occurs on the hub wall surface side in the diffuser flow path, the width of the diffuser flow path is substantially narrowed by the reverse flow region. Then, it may be impossible to sufficiently reduce the flow velocity. In addition, the pressure loss at the diffuser increases due to the reverse flow. As a result, the static pressure of the fluid cannot be sufficiently raised by the diffuser, which leads to a decline in the efficiency of the centrifugal compressor and, in turn, a decline in the efficiency of the turbocharger. In addition, expansion of the reverse flow occurring in the diffuser flow path leads to a stall (surge) of the diffuser. Accordingly, it is necessary to maintain a flow rate at which no stall occurs, which is an obstacle to the industrial demand of surge margin expansion. The surge margin is the difference between the flow rate at the maximum efficiency point and the flow rate at the stall-occurring surge point.

The present invention has been made in view of the above, and an object of the present invention is to prevent a reverse flow from occurring on a hub wall surface side forming a diffuser flow path, improve the efficiency of a centrifugal compressor, improve the efficiency of a turbocharger provided with the centrifugal compressor, and expand the surge margin of the centrifugal compressor.

Solution to Problem

In order to solve the problems mentioned above and achieve the purpose, the present invention provides a centrifugal compressor including an impeller boosting a fluid by rotation about a rotating shaft and a diffuser converting a dynamic pressure of a fluid boosted by the impeller into a static pressure, in which the diffuser has a shroud wall surface extending in a radial direction of the rotating shaft and a hub wall surface extending in the radial direction and opposing the shroud wall surface on a downstream side of a flow in an axial direction of the rotating shaft, having a gap between the hub wall surface and the shroud wall surface, and forming an annular diffuser flow path with the gap, the fluid flowing through the diffuser flow path, and a hub-side convex portion is formed over an entire periphery of the hub wall surface, the hub-side convex portion protruding toward the shroud wall surface side relative to a straight line connecting a starting end on an inlet side of the diffuser flow path and a terminating end on an outlet side of the diffuser flow path.

In this configuration, the region on the hub wall surface side where a reverse flow is likely to occur in the diffuser flow path during operation at a low flow rate in particular can be closed in advance by the hub-side convex portion. In addition, the boundary layer of the flow on the hub wall surface side can be reduced in thickness by the hub-side convex portion, and thus it is possible to narrow the range in which a fluid having a low circumferential flow velocity and a small centrifugal force is incapable of resisting the radially inward force that acts on the fluid in the diffuser flow path. Further, since the width of the diffuser flow path is narrowed by the hub-side convex portion, the main flow velocity in the diffuser flow path can be increased. As a result, a reverse flow can be prevented from occurring at the boundary layer of the flow on the hub wall surface side in the diffuser flow path. As a result, the static pressure can be sufficiently raised by the diffuser. In addition, a stall of the diffuser attributable to a reverse flow can be prevented, and thus the flow rate at a surge point can be reduced and the centrifugal compressor can be operated at a lower flow rate. Accordingly, with the centrifugal compressor according to the present invention, a reverse flow can be prevented from occurring on the hub wall surface side forming the diffuser flow path, the efficiency of the centrifugal compressor can be improved, the efficiency of a turbocharger provided with the centrifugal compressor can be improved, and the surge margin of the centrifugal compressor can be expanded.

Preferably, a vertex of the hub-side convex portion is provided in a range inward in the radial direction from a central portion of the hub-side convex portion in the radial direction.

With this configuration, the vertex of the hub-side convex portion can be brought close to the inlet side of the diffuser flow path, and thus it is possible to satisfactorily prevent a reverse flow on the hub wall surface side that is likely to occur at the front half part of the diffuser flow path on the inlet side.

Preferably, a vertex of the hub-side convex portion is formed at a radial position 1.05 times or more and 1.4 times or less a radius from the rotating shaft at the inlet of the diffuser flow path.

With this configuration, it is possible to satisfactorily prevent a reverse flow on the hub wall surface side that is likely to occur at the radial position which is 1.05 times to 1.4 times the inlet radius at the inlet of the diffuser flow path.

Preferably, the hub-side convex portion is provided inside a position in the radial direction, the position having a radius of 0.9 times or less a radius from the rotating shaft at the outlet of the diffuser flow path.

With this configuration, a reverse flow on the hub wall surface side that is likely to occur at the front half part of the diffuser flow path on the inlet side in the radial direction can be satisfactorily prevented and, at the same time, it is possible to prevent the width of the diffuser flow path from being narrowed in an excessive radius region in the region where the hub-side convex portion reaches the vicinity of the outlet. As a result, it is possible to achieve a sufficient deceleration of the flow by means of the diffuser.

Preferably, the hub-side convex portion has a distance from the straight line to a vertex in the axial direction ranging from 0.1 times to 0.3 times a width of the diffuser flow path at the outlet.

With this configuration, it is possible to prevent the diffuser flow path from being excessively narrowed in the width direction by the hub-side convex portion, and thus it is possible to achieve a sufficient deceleration of the flow by means of the diffuser.

Preferably, the hub-side convex portion is formed so as to have a size at which an annular area as a product of a circumferential length and a width of the diffuser flow path at any radial position increases as compared with an annular area as a product of a circumferential length and a width of the diffuser flow path at the inlet.

With this configuration, an excessive decrease in the annular area of the diffuser flow path attributable to the hub-side convex portion can be prevented, and thus it is possible to achieve a sufficient deceleration of the flow by means of the diffuser.

Preferably, the shroud wall surface has a shroud-side concave portion provided so as to oppose the hub-side convex portion and be concave to a side opposite to the hub wall surface.

With this configuration, an excessive decrease in the width of the diffuser flow path can be prevented by the shroud-side concave portion even with the hub wall surface provided with the hub-side convex portion. Accordingly, it is possible to prevent an excessive increase in the main flow velocity in the diffuser flow path attributable to the provided hub-side convex portion. As a result, a pressure loss attributable to wall surface friction can be prevented and adjustment can be performed in a more appropriate manner such that flow deceleration by the diffuser and, in turn, the rate of recovery of the static pressure of the fluid reaches a desired value.

Preferably, the shroud-side concave portion is formed so as to have a size at which a width of the diffuser flow path becomes constant between the hub-side convex portion and the shroud-side concave portion as a limit.

With this configuration, it is possible to prevent an excessive increase in the width of the diffuser flow path between the hub-side convex portion and the shroud-side concave portion and it is possible to prevent the flow from losing uniformity in the diffuser flow path. As a result, it becomes possible to more appropriately adjust the rate of recovery of the static pressure of the fluid by the diffuser.

Preferably, the impeller has an impeller hub rotating integrally with the rotating shaft and a blade attached to the impeller hub, the impeller hub includes a linear portion extending in a direction orthogonal to the rotating shaft to an impeller outlet, and the hub wall surface forming the diffuser flow path extends obliquely toward the downstream side in the axial direction from the starting end toward the terminating end.

In this configuration, the hub wall surface inclined toward the axially downstream side from the starting end toward the terminating end is capable of smoothly guiding, into the diffuser flow path, a flow in which a force toward the axially downstream side remains in the vicinity of the inlet of the diffuser flow path, that is, the impeller outlet. As a result, a pressure loss at the inlet of the diffuser flow path can be prevented, the rate of static pressure recovery by the diffuser can be further increased, and the efficiency of the centrifugal compressor and the efficiency of the turbocharger can be further improved.

Preferably, the impeller has an impeller hub rotating integrally with the rotating shaft and a blade attached to the impeller hub, the impeller hub includes an inclined portion extending obliquely toward the downstream side in the axial direction toward the hub wall surface forming the diffuser flow path, and the hub wall surface forming the diffuser flow path has a hub-side concave portion concave toward a side opposite to the shroud wall surface at an inclination angle conforming to an inclination angle of the impeller hub radially inside the hub-side convex portion.

In this configuration, impeller hub is inclined at the impeller outlet and the hub-side concave portion formed at an inclination angle conforming to the inclination angle of the impeller hub is capable of smoothly guiding the flow into the diffuser flow path even in a case where the force toward the downstream side in the axial direction of the flow becomes stronger in the vicinity of the inlet of the diffuser flow path. As a result, a pressure loss at the inlet of the diffuser flow path can be prevented, the rate of static pressure recovery by the diffuser can be further increased, and the efficiency of the centrifugal compressor and the efficiency of the turbocharger can be further improved.

Preferably, the shroud wall surface has an asymptotic portion asymptotic toward the hub wall surface side radially outward from the inlet.

With this configuration, the width of the diffuser flow path in the vicinity of the inlet can be narrowed by the asymptotic portion of the shroud wall surface, and thus the boundary layer of the flow on the shroud wall surface side, which is likely to become thick in the vicinity of the inlet, can be reduced in thickness. As a result, the thickness of the boundary layer of the flow on the shroud wall surface side and the thickness of the boundary layer of the flow on the hub wall surface side can become uniform in the vicinity of the inlet of the diffuser flow path and the flow can be pushed out toward the hub wall surface side as a whole. As a result, the boundary layer of the flow on the hub wall surface side can be further reduced in thickness and it is possible to prevent a reverse flow at the boundary layer of the flow on the hub wall surface side.

In order to solve the problems mentioned above and achieve the purpose, a turbocharger according to the present invention includes the centrifugal compressor.

With this configuration, a reverse flow can be prevented from occurring on the hub wall surface side forming the diffuser flow path, the efficiency of the centrifugal compressor can be improved, the efficiency of the turbocharger provided with the centrifugal compressor can be improved, and the surge margin of the centrifugal compressor can be expanded.

Advantageous Effects of Invention

With the centrifugal compressor and the turbocharger according to the present invention, a reverse flow can be prevented from occurring on the hub wall surface side forming the diffuser flow path, the efficiency of the centrifugal compressor can be improved, the efficiency of the turbocharger provided with the centrifugal compressor can be improved, and the surge margin of the centrifugal compressor can be expanded.

DESCRIPTION OF EMBODIMENTS

Hereinafter, embodiments of a centrifugal compressor and a turbocharger according to the present invention will be described in detail with reference to accompanying drawings. It should be noted that this invention is not limited by the embodiments.

First Embodiment

Figure 1:
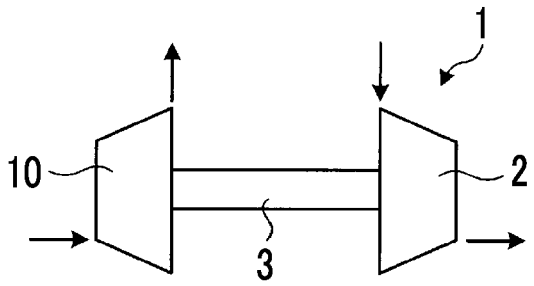
FIG. 1 is a schematic configuration diagram illustrating a turbocharger according to a first embodiment.

FIG. 1 is a schematic configuration diagram illustrating a turbocharger according to a first embodiment. A turbocharger (exhaust turbocharger) 1 according to the first embodiment is provided with a centrifugal compressor (compressor) 10 and a turbine 2. The turbocharger 1 is provided adjacent to an internal combustion engine (not illustrated). In the turbocharger 1, the centrifugal compressor 10 and the turbine 2 are coaxially connected via a rotating shaft 3. In the turbocharger 1, the turbine 2 is rotationally driven by exhaust gas exhausted from the internal combustion engine (not illustrated) and the centrifugal compressor 10 is driven by the rotating shaft 3. As a result, a fluid such as air taken into the centrifugal compressor 10 from the outside is compressed and pumped toward the internal combustion engine (not illustrated).

Figure 2:
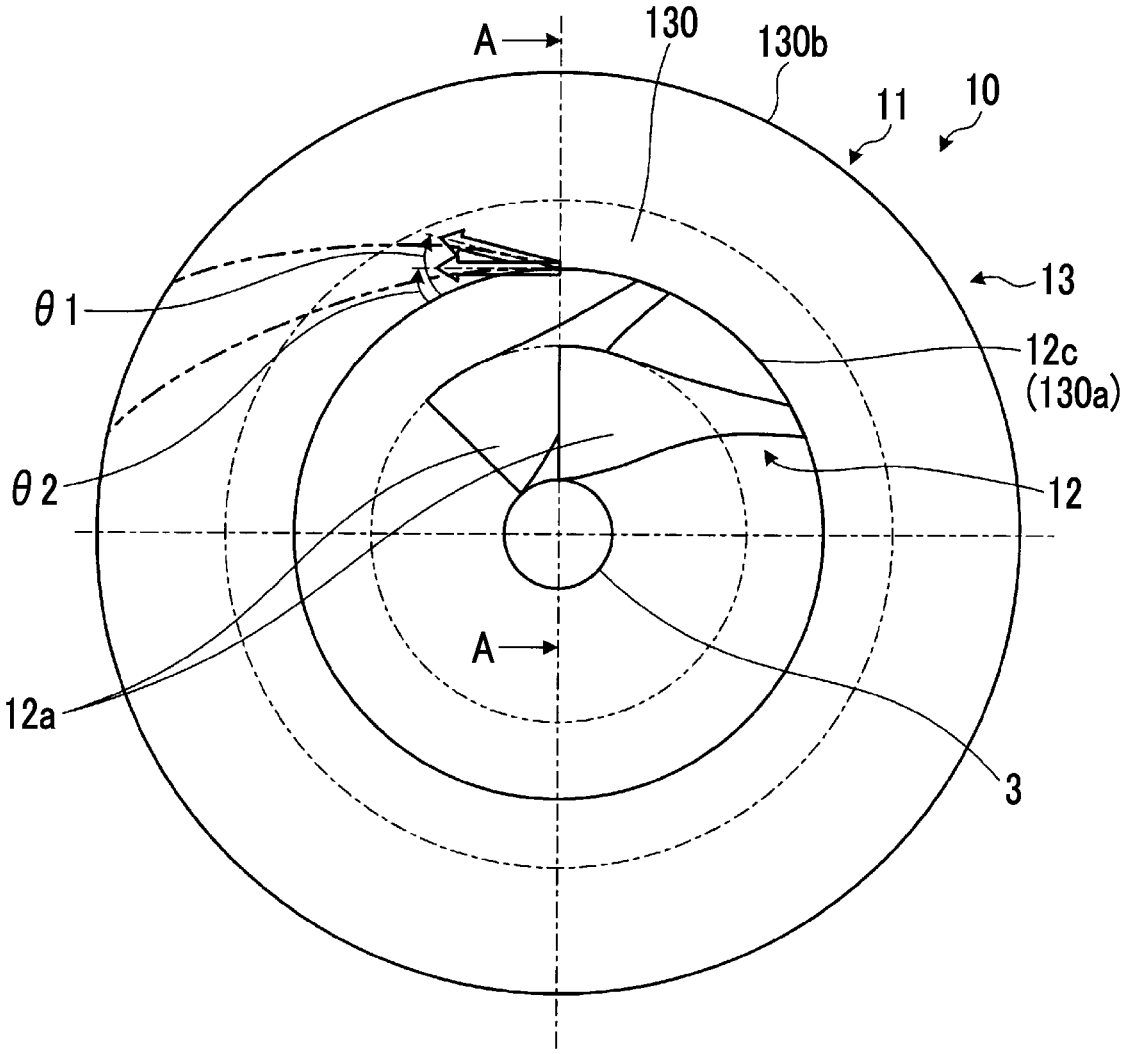
FIG. 2 is a front view illustrating a centrifugal compressor according to the first embodiment.
Figure 3:
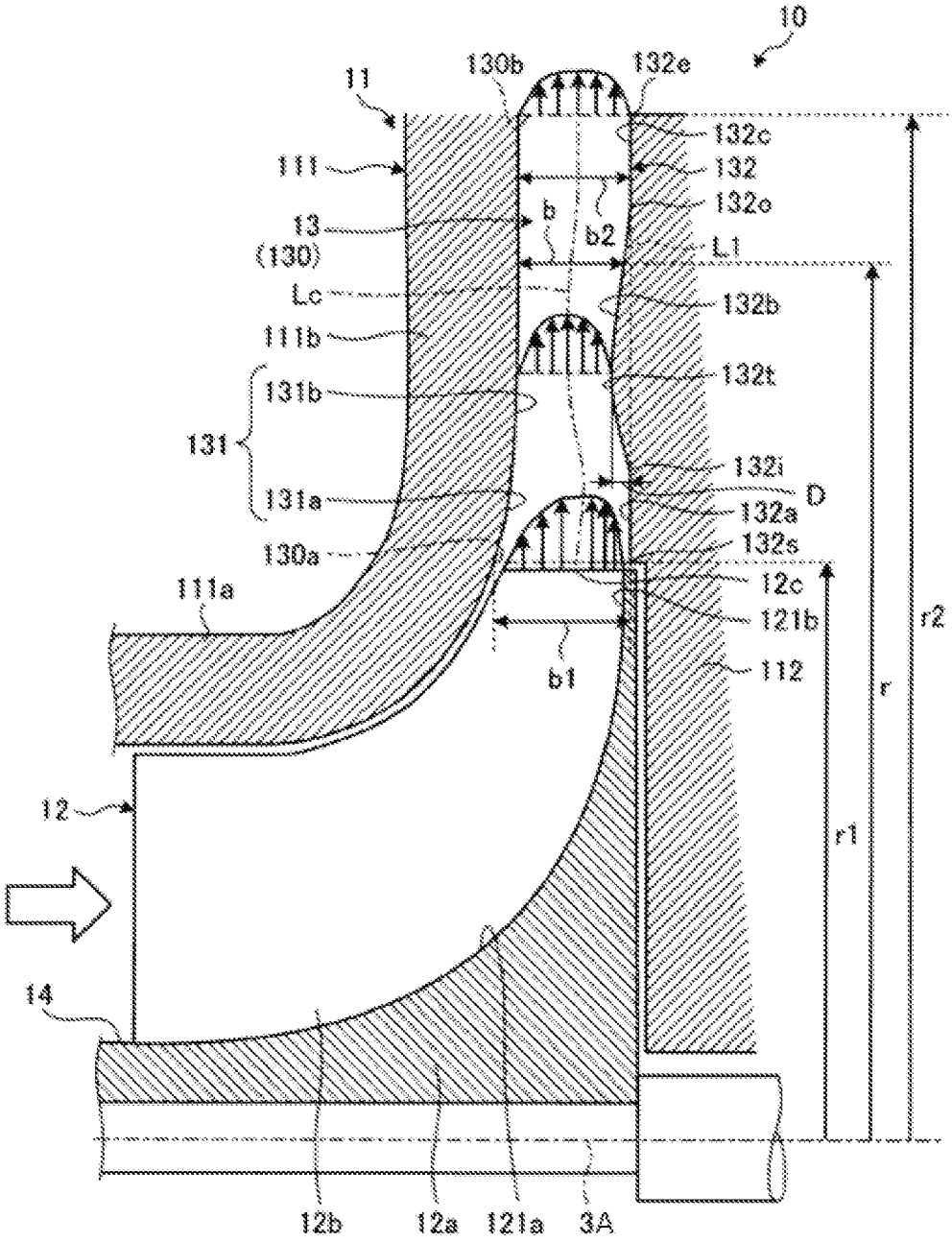
FIG. 3 is a cross-sectional view illustrating the centrifugal compressor according to the first embodiment.

FIG. 2 is a front view illustrating the centrifugal compressor according to the first embodiment, and FIG. 3 is a cross-sectional view illustrating the centrifugal compressor according to the first embodiment. FIG. 3 illustrates a meridional section including the rotating shaft 3 along line A-A of FIG. 2 (hereinafter, simply referred to as "meridional section"). As illustrated in FIGS. 2 and 3, the centrifugal compressor 10 according to the first embodiment is provided with a casing 11, an impeller 12, and a diffuser 13. The centrifugal compressor 10 is formed in an axisymmetric structure that has the rotating shaft 3 as the center of the axisymmetric structure.

The casing 11 has a shroud 111 and a hub 112. As illustrated in FIG. 3, the shroud 111 has a tubular portion 111*a* extending in the axial direction of the rotating shaft 3 (hereinafter, simply referred to as "axial direction") and a disk-shaped portion 111*b* extending in the radial direction of the rotating shaft 3 of the tubular portion 111*a* (hereinafter, simply referred to as "radial direction"). In FIGS. 3, 4 and 7-10 the axis of the rotating shaft 3A is shown. The tubular portion 111*a* forms a suction passage 14 along the axial direction. The disk-shaped portion 111*b* extends radially outward substantially along a direction orthogonal to the rotating shaft 3 after extending while curving radially outward from the tubular portion 111*a*. The hub 112 is an annular disk disposed so as to oppose the disk-shaped portion 111*b* of the shroud 111. The hub 112 rotatably supports the rotating shaft 3.

The impeller 12 has an impeller hub 12*a* integrally attached to the rotating shaft 3 and a plurality of blades 12*b* provided at equal intervals on the outer periphery of the impeller hub 12*a*. The outer periphery of the impeller 12 is covered with the curved part of the disk-shaped portion 111*b* and the tubular portion 111*a* of the shroud 111 except for an impeller outlet 12*c*, which is the position of the peripheral edge of the blade 12*b*. The impeller 12 is capable of taking in a fluid via the suction passage 14 of the shroud 111. As illustrated in FIG. 3, in the present embodiment, the impeller hub 12*a* has a back plate portion 121*a* as a part of the outer peripheral surface of the impeller hub 12*a* to which the blade 12 is attached, the back plate portion 121*a* extends radially outward, and the back plate portion 121*a* includes a linear portion 121*b* extending to the impeller outlet 12*c* in the direction orthogonal to the rotating shaft 3.

In the first embodiment, the diffuser 13 is a vaneless diffuser. The diffuser 13 is disposed on the downstream side of the impeller 12. The diffuser 13 is an annular space formed by the hub 112 and the disk-shaped portion 111*b* of the shroud 111 and communicating with the impeller outlet 12*c*. In other words, the diffuser 13 has a shroud wall surface 131 formed by a part of the disk-shaped portion 111*b* of the shroud 111 and a hub wall surface 132 formed by the hub 112. The shroud wall surface 131 is a part of the inner wall surface of the disk-shaped portion 111*b* and extends radially outward radially outside the impeller outlet 12*c*. The hub wall surface 132 is a part of the inner wall surface of the hub 112 and extends radially outward, while opposing the shroud wall surface 131, radially outside the impeller outlet 12*c*. The hub wall surface 132 has a gap between the hub wall surface 132 and the shroud wall surface 131. An annular diffuser flow path 130 is formed by the gap between the shroud wall surface 131 and the hub wall surface 132. A fluid discharged from the impeller outlet 12*c* flows through the diffuser flow path 130.

Once the rotating shaft 3 rotates as the turbine 2 is driven, the impeller 12 rotates and a fluid is suctioned into the casing 11 through the suction passage 14. After the suctioning into the casing 11, the fluid is boosted during passage through the impeller 12 rotating about the rotating shaft 3. Subsequently, the fluid is discharged from the impeller outlet 12*c* toward the diffuser 13. The fluid discharged from the impeller outlet 12*c* toward the diffuser 13 flows radially outward as indicated by the solid-line arrows in FIG. 3 while turning in the circumferential direction of the rotating shaft 3 (hereinafter, simply referred to as "circumferential direction") in the diffuser flow path 130 as indicated by a two-dot chain line in FIG. 2. At this time, the fluid is decelerated by the frictional force of the shroud wall surface 131 and the hub wall surface 132. In addition, the flow velocity of the fluid in the turning direction is decreased as the radius of the diffuser flow path 130 (hereinafter, simply referred to as "radius") increases from the rotating shaft 3. Further, as the fluid heads radially outward, the fluid is decelerated with an increase in the cross-sectional area of the diffuser flow path 130. As a result, the fluid undergoes dynamic-to-static pressure conversion while passing through the diffuser 13 and the static pressure rises (recovers). The centrifugal compressor 10 supplies the internal combustion engine (not illustrated) with the fluid boosted in this manner. It should be noted that a mechanism such as a scroll may be provided in the outer peripheral portion of the diffuser 13.

Next, the diffuser 13 of the centrifugal compressor 10 according to the first embodiment will be described in detail. As illustrated in FIG. 3, the shroud wall surface 131 of the diffuser 13 has an asymptotic portion 131*a* asymptotic toward the hub wall surface 132 side radially outward from an inlet 130*a* of the diffuser flow path 130 and a linear portion 131*b* extending in the direction orthogonal to the rotating shaft 3 from the asymptotic portion 131*a* to an outlet 130*b* of the diffuser flow path 130.

As illustrated in FIG. 3, the hub wall surface 132 of the diffuser 13 has a first linear portion 132*a* extending in the direction orthogonal to the rotating shaft 3 radially outward from the inlet 130*a* of the diffuser flow path 130, a hub-side convex portion 132*b* extending radially outward from the first linear portion 132*a*, and a second linear portion 132*c* extending in the direction orthogonal to the rotating shaft 3 from the hub-side convex portion 132*b* to the outlet 130*b* of the diffuser flow path 130.

Here, a straight line connecting a starting end 132*s* of the hub wall surface 132 on the inlet 130*a* side of the diffuser flow path 130 and a terminating end 132*e* of the hub wall surface 132 on the outlet 130*b* side of the diffuser flow path 130 is defined as a straight line L1. In the first embodiment, the straight line L1 is the same direction as the direction orthogonal to the rotating shaft 3 and the first linear portion 132*a* and the second linear portion 132*c* of the hub wall surface 132 extend along the straight line L1.

The hub-side convex portion 132*b* is a part that protrudes toward the shroud wall surface 131 side relative to the straight line L1 connecting the starting end 132*s* and the terminating end 132*e* of the hub wall surface 132. As described above, the centrifugal compressor 10 is formed in an axisymmetric structure having the rotating shaft 3 as the center of the axisymmetric structure, and thus the hub-side convex portion 132*b* is formed over the entire periphery of the hub wall surface 132. In the first embodiment, the hub-side convex portion 132*b* is formed in the shape of a smooth curve that has a curvature continuously changing between the first linear portion 132*a* and the second linear portion 132*c*. The hub-side convex portion 132*b* extends, while approaching the shroud wall surface 131 side, radially outward from an innermost peripheral portion 132*i* on the first linear portion 132*a* side and approaches the shroud wall surface 131 most at a vertex 132*t*. The hub-side convex portion 132*b* extends away from the shroud wall surface 131 radially outward from the vertex 132*t* to an outermost peripheral portion 132*o* on the second linear portion 132*c* side.

In the first embodiment, the innermost peripheral portion 132*i* of the hub-side convex portion 132*b* is provided radially outside the starting end 132*s* and the outermost peripheral portion 132*o* of the hub-side convex portion 132*b* is provided radially inside the terminating end 132*e*. Preferably, the outermost peripheral portion 132*o* of the hub-side convex portion 132*b* is provided radially inside the position that has a radius of 0.9 times or less an outlet radius r2 at the outlet 130*b* of the diffuser flow path 130. In other words, it is preferable that the hub-side convex portion 132*b* is provided radially inside the position that has a radius of 0.9 times or less the outlet radius r2.

Preferably, the vertex 132*t* of the hub-side convex portion 132*b* is provided in the range that is radially inward from the central portion of the hub-side convex portion 132*b* in the radial direction, that is, the intermediate position between the innermost peripheral portion 132*i* and the outermost peripheral portion 132*o* in the radial direction.

More specifically, it is preferable that the vertex 132*t* of the hub-side convex portion 132*b* is formed at the radial position that is 1.1 times or more and 1.4 times or less an inlet radius r1 at the inlet 130*a* of the diffuser flow path 130. More preferably, the vertex 132*t* of the hub-side convex portion 132*b* is formed at the radial position that is 1.05 times or more and 1.4 times or less the inlet radius r1. In a case where the value that is obtained by an inlet width b1 of the diffuser flow path 130 at the inlet 130*a* being divided by the inlet radius r1 is approximately 0.05, it is preferable that the vertex 132*t* is formed at the radial position that is 1.1 times or more and 1.2 times or less the inlet radius r1. In a case where the value that is obtained by the inlet width b1 of the diffuser flow path 130 at the inlet 130*a* being divided by the inlet radius r1 is approximately 0.2, it is preferable that the vertex 132*t* is formed at the radial position that is 1.3 times or more and 1.4 times or less the inlet radius r1.

As for the hub-side convex portion 132*b*, it is preferable that a distance D from the straight line L1 to the vertex 132*t* in the axial direction is 0.1 times or more and 0.3 times or less an outlet width b2 of the diffuser flow path 130 at the outlet 130*b*.

Preferably, the inlet width b1 and the inlet radius r1 of the diffuser flow path 130 at the inlet 130*a* and a width b and a radius r of the diffuser flow path 130 at any radial position in the range where the hub-side convex portion 132*b* is formed satisfy the relationship of the following Equation (1). The left side in Equation (1) represents the annular area that is the product of circumferential length "2πr" and the width b of the diffuser flow path 130 at any radial position. The right side in Equation (1) represents the annular area that is the product of circumferential length "2πr1" and the width b1 of the diffuser flow path 130 at the inlet 130*a*. In other words, it is preferable that the hub-side convex portion 132*b* is formed so as to have a size at which the annular area that is the product of circumferential length "2πr" and the width b of the diffuser flow path 130 at any radial position increases as compared with the annular area that is the product of circumferential length "2πr1" and the width b1 of the diffuser flow path 130 at the inlet 130*a*.

$$b \cdot 2\pi r > b1 \cdot 2\pi r1 \quad (1)$$

Figure 4:
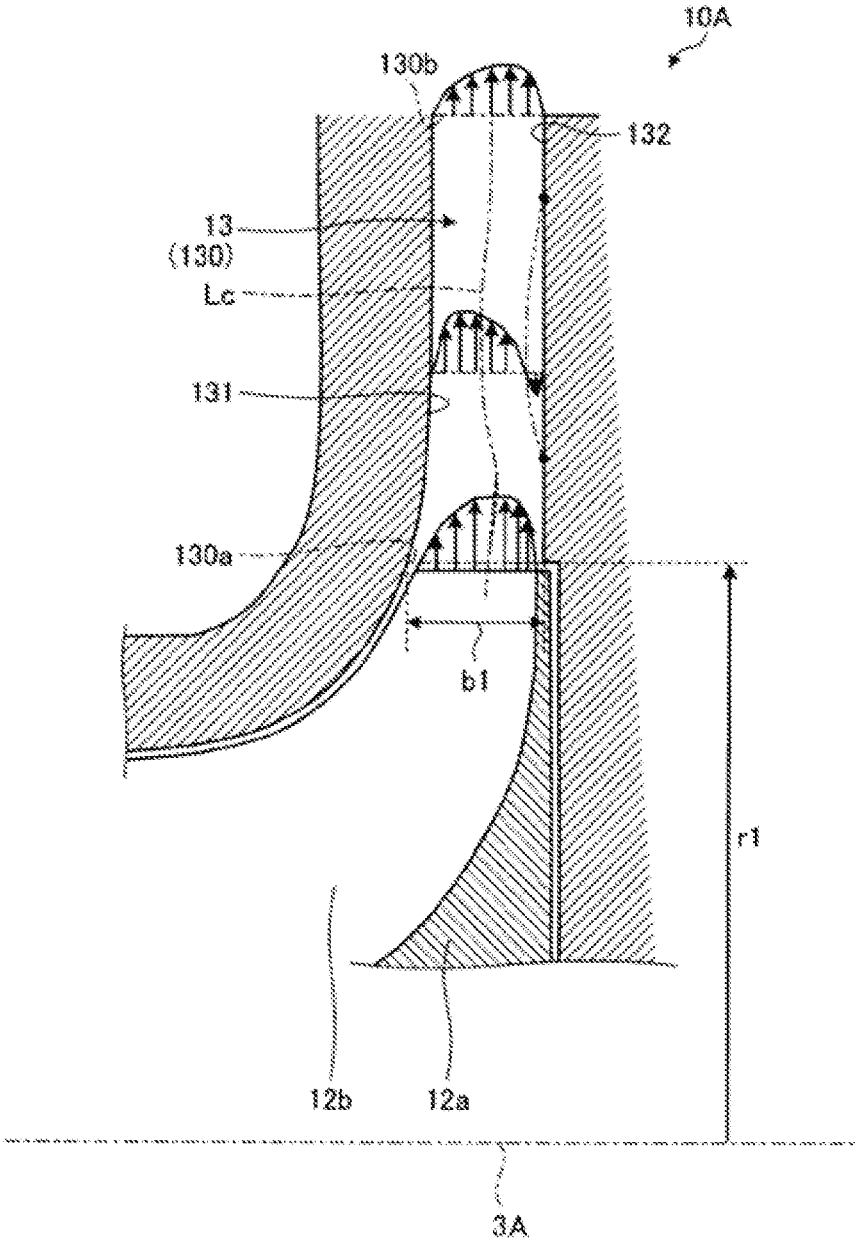
FIG. 4 is a cross-sectional view illustrating a centrifugal compressor as a comparative example.
Figure 5:
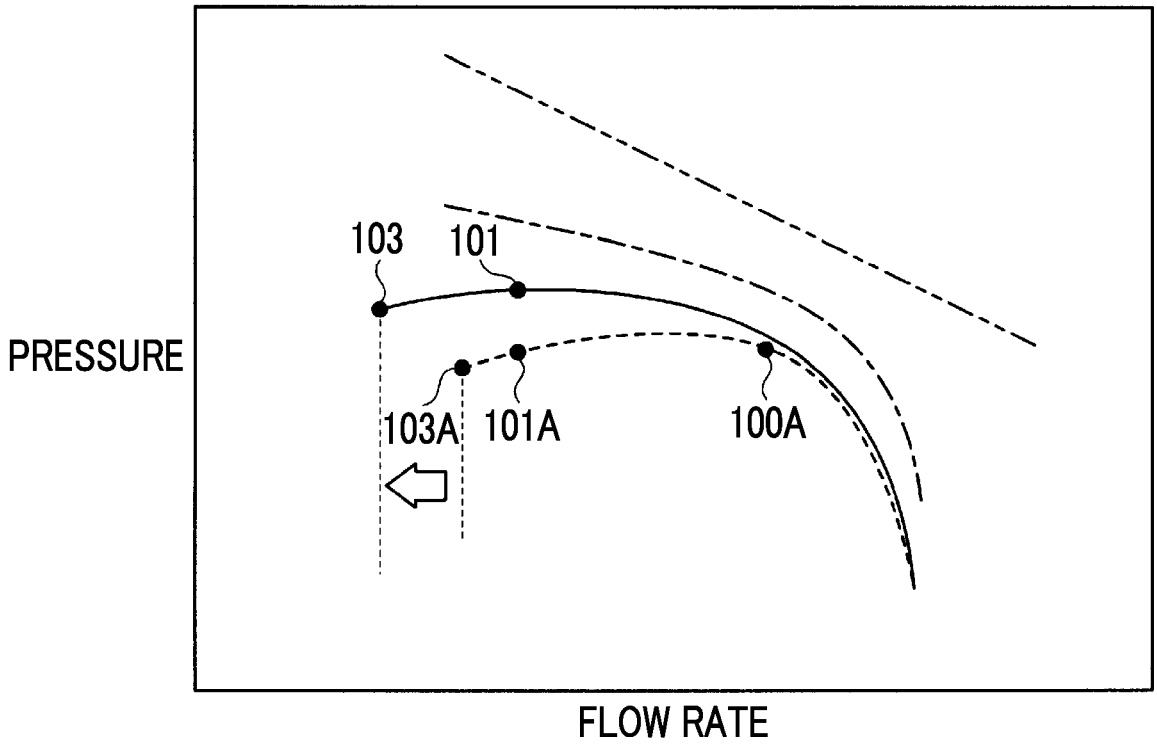
FIG. 5 is an explanatory diagram illustrating an example of the flow rate-pressure characteristics of the centrifugal compressor according to the first embodiment and an example of the flow rate-pressure characteristics of the centrifugal compressor as the comparative example.

Next, the action of the centrifugal compressor 10 according to the first embodiment will be described based on comparison with a comparative example. FIG. 4 is a cross-sectional view illustrating a centrifugal compressor as the comparative example. FIG. 5 is an explanatory diagram illustrating an example of the flow rate-pressure characteristics of the centrifugal compressor according to the first embodiment and an example of the flow rate-pressure characteristics of the centrifugal compressor as the comparative example. The solid line in FIG. 5 is an example of the flow rate-pressure characteristics of the centrifugal compressor 10 according to the first embodiment, and the dashed line in FIG. 5 is an example of the flow rate-pressure characteristics of a centrifugal compressor 10A as the comparative example. It should be noted that the two-dot chain line in FIG. 5 indicates ideal flow rate-pressure characteristics in a case where it is assumed that there is no pressure loss in the impeller 12 and the diffuser 13 and the one-dot chain line in FIG. 5 indicates the flow rate-pressure characteristics in a case where it is assumed that there is no pressure loss in the diffuser 13 with the pressure loss in the impeller 12 taken into account.

Regarding the centrifugal compressor 10A as the comparative example, the solid-line arrows in FIG. 4 indicate the radial component of the flow velocity in the diffuser flow path 130 at a time when the centrifugal compressor 10A operates at a low flow operation point 101A (see FIG. 5), which is lower in flow rate than a normal operation point 100A (see FIG. 5) near the maximum efficiency point. It should be noted that a flow angle θ2 in the turning direction decreases by approximately ⅔ to ½ from a flow angle θ1 in the case of the normal operation point 100A as illustrated in, for example, FIG. 2 when the centrifugal compressor 10A operates at the low flow operation point 101A.

As illustrated in FIG. 4 and unlike the centrifugal compressor 10 according to the first embodiment, the hub wall surface 132 of the diffuser 13 of the centrifugal compressor 10A as the comparative example does not have the hub-side convex portion 132*b*. In the centrifugal compressor 10A as the comparative example, the hub wall surface 132 of the diffuser 13 extends perpendicularly in the radial direction along the direction orthogonal to the rotating shaft 3. The other constituent elements of the centrifugal compressor 10A and the size and the like of each constituent element are similar to those of the centrifugal compressor 10, and thus will not be described. Hereinafter, the flow of the fluid in the diffuser flow path 130 will be described first with reference to FIG. 4 regarding the centrifugal compressor 10A as the comparative example.

As illustrated in FIG. 4, in the centrifugal compressor 10A as the comparative example, the radial component of the flow velocity of the fluid that has flowed into the diffuser flow path 130 has a boundary layer in the vicinity of the shroud wall surface 131 and the hub wall surface 132. In general, in the vicinity of the inlet 130*a*, the force with which the flow heads toward the downstream side in the axial direction (right side in FIG. 4, hereinafter, simply referred to as "axially downstream side") after passing through the impeller 12 remains, and thus the boundary layer on the hub wall surface 132 side becomes thin and the boundary layer on the shroud wall surface 131 side becomes thick. As the flow in the diffuser flow path 130 heads toward the outlet 130*b* side, the force toward the axially downstream side decreases. Accordingly, in general, the boundary layer on the shroud wall surface 131 side and the boundary layer on the hub wall surface 132 side gradually become uniform as the flow in the diffuser flow path 130 heads toward the outlet 130*b* side in a case where the centrifugal compressor 10A operates at the flow rate at the normal operation point 100A.

A reverse flow may occur at the boundary layer of the flow on the hub wall surface 132 side as illustrated in FIG. 4 in a case where the centrifugal compressor 10A operates at the flow rate at the low flow operation point 101A. This is because the circumferential component of the flow velocity is smaller (that is, the centrifugal force of the flow is smaller) on the hub wall surface 132 side than on the shroud wall surface 131 side and it may become impossible to resist the radially inward force acting on the fluid in the diffuser flow path 130, where the static pressure of the fluid increases as the radius increases.

In FIG. 4, the range that is closer to the hub wall surface 132 side than the line indicated by the two-dot chain line is a reverse flow region where the reverse flow has occurred. In a general vaneless diffuser, the reverse flow region is usually generated from the radial position that is 1.1 times or more and 1.2 times or less the inlet radius r1 in a case where the value that is obtained by the inlet width b1 of the diffuser flow path 130 at the inlet 130*a* being divided by the inlet radius r1 of the inlet 130*a* is approximately 0.05. In addition, the reverse flow region is usually generated from the radial position that is 1.1 times or more and 1.2 times or less the inlet radius r1 in a case where the value that is obtained by the inlet width b1 of the diffuser flow path 130 at the inlet 130*a* being divided by the inlet radius r1 is approximately 0.2. In other words, in a general vaneless diffuser, the reverse flow region is usually generated from the radial position that is 1.1 times or more and 1.4 times or less the inlet radius r1 of the inlet 130*a* of the diffuser flow path 130.

Once a reverse flow occurs on the hub wall surface 132 side in the diffuser flow path 130, a flow center line Lc (center line of flow rate bisection in the width direction of the diffuser flow path 130) moves toward the shroud wall surface 131 side in the vicinity of the reverse flow region as the center line Lc heads radially outward from the inlet 130*a*. Then, the flow rate in the vicinity of the shroud wall surface 131 relatively increases, and thus no reverse flow is likely to occur at the boundary layer on the shroud wall surface 131 side. Subsequently, the center line Lc of the flow heading toward the outlet 130*b* from the vicinity of the reverse flow region gradually moves toward the hub wall surface 132 side, and thus the center line Lc draws an S shape as a whole.

The reverse flow region at the boundary layer on the hub wall surface 132 side expands in a case where the centrifugal compressor 10A is operated with the flow rate further reduced from the example that is illustrated in FIG. 4. Once the reverse flow region reaches the outlet 130*b* of the diffuser flow path 130, a flow with a small turning-direction energy flows from the outlet 130*b* into the diffuser flow path 130 (reverse flow region). As a result, the reverse flow region expands over the entire width of the diffuser flow path 130 in the vicinity of the outlet 130*b*, boosting of the fluid by the diffuser 13 becomes impossible, and a stall (surge) of the diffuser 13 occurs. The flow rate at which the stall of the diffuser 13 occurs is defined as a surge point 103A in FIG. 5.

Once a reverse flow occurs on the hub wall surface 132 side in the diffuser flow path 130 as described above, the width of the diffuser flow path 130 is substantially narrowed by the reverse flow region. Then, it may be impossible to sufficiently reduce the flow velocity. In addition, the pressure loss at the diffuser 13 increases due to the reverse flow. As a result, the static pressure of the fluid cannot be sufficiently raised by the diffuser 13, which leads to a decline in the efficiency of the centrifugal compressor 10A and, in turn, a decline in the efficiency of the turbocharger 1. In addition, the expansion of the reverse flow occurring in the diffuser flow path 130 leads to a stall (surge) of the diffuser 13 as described above. Accordingly, it is necessary to maintain a flow rate at which no stall occurs, which is an obstacle to the industrial demand of expansion of a surge margin as the difference between the flow rate at the normal operation point 100A and the flow rate at the stall-occurring surge point 103A.

In order to solve this problem, the hub wall surface 132 of the diffuser 13 of the centrifugal compressor 10 according to the first embodiment has the hub-side convex portion 132*b*. The hub-side convex portion 132*b* is formed in a reverse flow-prone region at the boundary layer on the hub wall surface 132 side. Accordingly, the region on the hub wall surface 132 side where a reverse flow is likely to occur in the diffuser flow path 130 during operation at a low flow rate in particular is closed in advance by the hub-side convex portion 132*b*. In addition, as illustrated in FIG. 3, the boundary layer of the flow on the hub wall surface 132 side in the vicinity of the hub-side convex portion 132*b* becomes thinner than in the centrifugal compressor 10A of the comparative example by the hub-side convex portion 132*b*. Narrowed as a result is the range in which a fluid having a low circumferential flow velocity and a small centrifugal force is incapable of resisting the radially inward force that acts on the fluid in the diffuser flow path 130. Further, since the width of the diffuser flow path 130 is narrowed by the hub-side convex portion 132*b*, the main flow velocity in the diffuser flow path 130 becomes higher than in the centrifugal compressor 10A of the comparative example. As a result, a reverse flow is prevented from occurring at the boundary layer of the flow on the hub wall surface 132 side in the diffuser flow path 130. As a result, the boundary layer on the shroud wall surface 131 side and the boundary layer on the hub wall surface 132 side gradually become uniform as the flow in the diffuser flow path 130 heads toward the outlet 130*b* side, as illustrated in FIG. 3, even in a case where the centrifugal compressor 10 is operated at a low flow operation point 101 (see FIG. 5), which is equal in flow rate to the low flow operation point 101A. In other words, it is possible to form a stable flow in the diffuser flow path 130 even in a case where the centrifugal compressor 10 is operated at the low flow operation point 101.

As a result, it is possible to prevent a reverse flow from occurring on the hub wall surface 132 side of the diffuser flow path 130, and thus the flow velocity of the flow can be sufficiently reduced by the diffuser 13 and it is possible to prevent a pressure loss in the diffuser 13. As a result, the static pressure of the fluid can be sufficiently raised, as illustrated in FIG. 5, by the diffuser 13 even during operation at a low flow rate as compared with the centrifugal compressor 10A of the comparative example and it is possible to improve the efficiency of the centrifugal compressor 10 and, in turn, the efficiency of the turbocharger 1. In addition, it is possible to improve the output of the internal combustion engine (not illustrated) by improving the efficiency of the centrifugal compressor 10 and the efficiency of the turbocharger 1.

In addition, a stall of the diffuser 13 attributable to a reverse flow can be prevented as a result of the reverse flow prevention on the hub wall surface 132 side. As described above, in the centrifugal compressor 10A of the comparative example, the reverse flow region expands up to the outlet 130*b* of the diffuser flow path 130 and a stall of the diffuser 13 occurs once a reverse flow occurs at the low flow operation point 101A illustrated in FIG. 5 and the flow rate decreases to the surge point 103A. In the centrifugal compressor 10 according to the first embodiment, in contrast, a reverse flow begins to occur when the flow rate has further decreased as compared with the low flow operation point 101, which is equal in flow rate to the low flow operation point 101A, and a stall of the diffuser 13 occurs when the flow rate has decreased to a surge point 103 illustrated in FIG. 5. In this manner, in the centrifugal compressor 10 according to the first embodiment, a reverse flow is less likely to occur and the reverse flow region is less likely to expand, even when the operation point is changed to a lower flow rate side, than in the centrifugal compressor 10A of the comparative example by the hub wall surface 132 being provided with the hub-side convex portion 132*b*. In other words, the flow rate at the surge point 103 at which a stall of the diffuser 13 occurs can be lower than the flow rate at the surge point 103A. Accordingly, the surge margin of the centrifugal compressor 10 can be expanded and the centrifugal compressor 10 can be operated at a lower flow rate.

As described above, according to the centrifugal compressor 10 and the turbocharger 1 according to the first embodiment, it is possible to prevent a reverse flow from occurring on the hub wall surface 132 side forming the diffuser flow path 130, the efficiency of the centrifugal compressor 10 can be improved, the efficiency of the turbocharger 1 can be improved, and the surge margin of the centrifugal compressor 10 can be expanded.

The vertex 132*t* of the hub-side convex portion 132*b* is provided in the range that is radially inward from the central portion of the hub-side convex portion 132*b* in the radial direction, that is, the intermediate position between the innermost peripheral portion 132*i* and the outermost peripheral portion 132*o* in the radial direction.

With this configuration, the vertex 132*t* of the hub-side convex portion 132*b* can be brought close to the inlet 130*a* side of the diffuser flow path 130, and thus it is possible to satisfactorily prevent a reverse flow on the hub wall surface 132 side that is likely to occur at the front half part of the diffuser flow path 130 on the inlet 130*a* side.

The vertex 132*t* of the hub-side convex portion 132*b* is formed at the radial position that is 1.05 times or more and 1.4 times or less the inlet radius r1 at the inlet 130*a* of the diffuser flow path 130.

With this configuration, it is possible to satisfactorily prevent a reverse flow on the hub wall surface 132 side that is likely to occur at the radial position which is 1.05 times to 1.4 times the inlet radius r1 at the inlet 130*a* of the diffuser flow path 130.

The hub-side convex portion 132*b* is provided radially inside the radial position that is 0.9 times or less the outlet radius r2 at the outlet 130*b* of the diffuser flow path 130.

With this configuration, a reverse flow on the hub wall surface 132 side that is likely to occur at the front half part of the diffuser flow path 130 on the inlet 130*a* side can be satisfactorily prevented and, at the same time, it is possible to prevent the width of the diffuser flow path 130 from being narrowed in an excessive radius region (region in the radial direction) in the region where the hub-side convex portion 132*b* reaches the vicinity of the outlet 130*b*. As a result, it is possible to achieve a sufficient deceleration of the flow by means of the diffuser 13.

As for the hub-side convex portion 132*b*, the distance D from the straight line L1 to the vertex 132*t* in the axial direction ranges from 0.1 times to 0.3 times the outlet width b2 of the diffuser flow path 130 at the outlet 130*b*.

With this configuration, it is possible to prevent the diffuser flow path 130 from being excessively narrowed in the width direction by the hub-side convex portion 132*b*, and thus it is possible to achieve a sufficient deceleration of the flow by means of the diffuser 13.

The hub-side convex portion 132*b* is formed so as to have a size at which the annular area that is the product of circumferential length "2πr" and the width b of the diffuser flow path 130 at any radial position increases as compared with the annular area that is the product of circumferential length "2πr1" and the width b1 of the diffuser flow path 130 at the inlet 130*a*.

With this configuration, an excessive decrease in the annular area of the diffuser flow path 130 attributable to the hub-side convex portion 132*b* can be prevented, and thus it is possible to achieve a sufficient deceleration of the flow by means of the diffuser 13.

The shroud wall surface 131 has the asymptotic portion 131*a* asymptotic to the hub wall surface 132 side radially outward from the inlet 130*a*.

With this configuration, the width of the diffuser flow path 130 in the vicinity of the inlet 130*a* can be narrowed by the asymptotic portion 131*a* of the shroud wall surface 131, and thus the boundary layer of the flow on the shroud wall surface 131 side, which is likely to become thick in the vicinity of the inlet 130*a*, can be reduced in thickness. As a result, the thickness of the boundary layer of the flow on the shroud wall surface 131 side and the thickness of the boundary layer of the flow on the hub wall surface 132 side can become uniform in the vicinity of the inlet 130*a* of the diffuser flow path 130 and the flow can be pushed out toward the hub wall surface 132 side as a whole. As a result, the boundary layer of the flow on the hub wall surface 132 side can be further reduced in thickness and it is possible to prevent a reverse flow at the boundary layer of the flow on the hub wall surface 132 side.

It should be noted that the shroud wall surface 131 may not have the asymptotic portion 131*a* in the first embodiment. In other words, the shroud wall surface 131 may have only a linear portion extending radially outward in the direction orthogonal to the rotating shaft 3.

Figure 6:
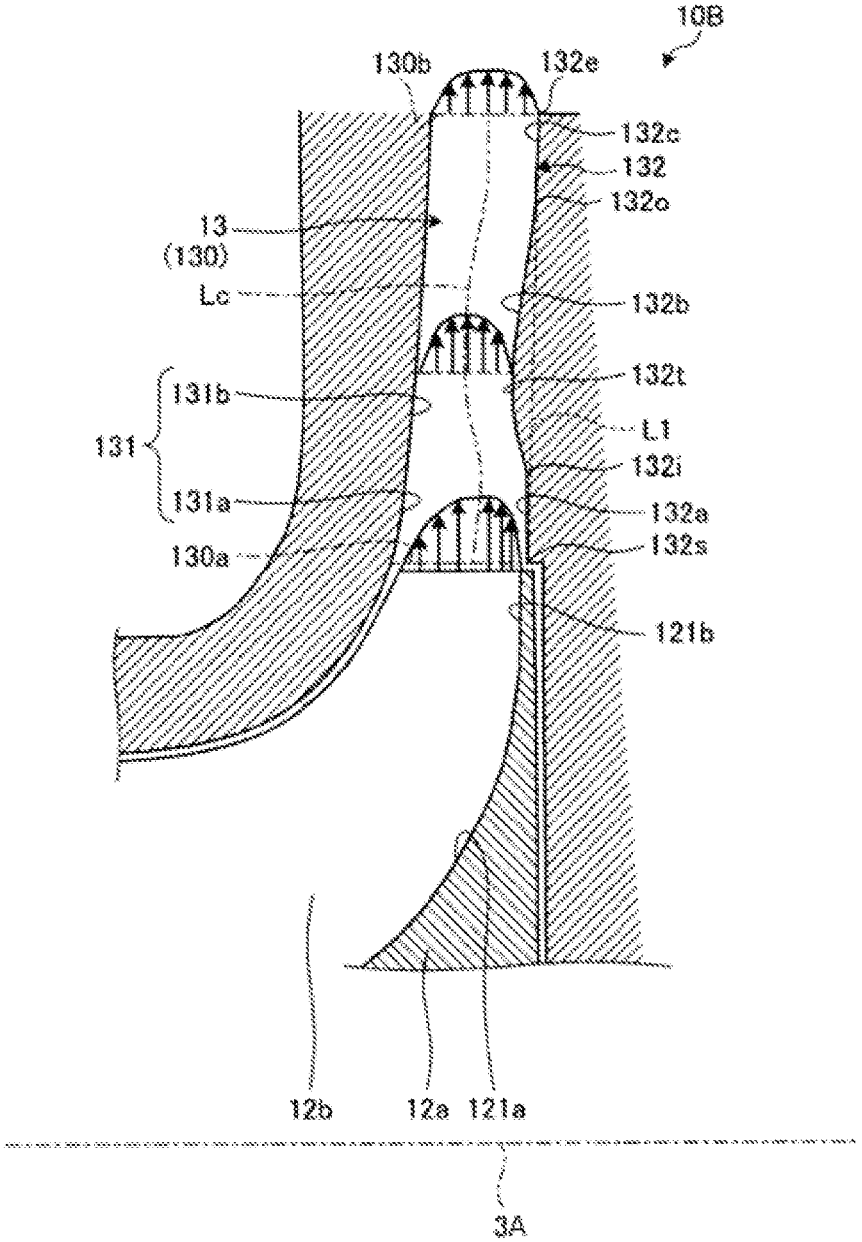
FIG. 6 is a cross-sectional view illustrating a centrifugal compressor according to a modification example of the first embodiment.

FIG. 6 is a cross-sectional view illustrating a centrifugal compressor according to a modification example of the first embodiment. As illustrated in FIG. 6, in a centrifugal compressor 10B according to the modification example, the linear portion 131*b* of the shroud wall surface 131 extends obliquely to the axially downstream side radially outward from the asymptotic portion 131*a*. As illustrated in FIG. 6, in the centrifugal compressor 10B according to the modification example, the second linear portion 132*c* of the hub wall surface 132 extends obliquely to the axially downstream side radially outward from the hub-side convex portion 132*b*. In the present embodiment, the inclination angle of the linear portion 131*b* of the shroud wall surface 131 and the inclination angle of the second linear portion 132*c* of the hub wall surface 132 are substantially equal to each other. Preferably, the inclination angle of the linear portion 131*b* of the shroud wall surface 131 and the inclination angle of the second linear portion 132*c* of the hub wall surface 132 are approximately five degrees to 10 degrees relative to the direction orthogonal to the rotating shaft 3.

Also with the centrifugal compressor 10B, in which the linear portion 131*b* of the shroud wall surface 131 and the second linear portion 132*c* of the hub wall surface 132 are inclined radially outward to the axially downstream side as described above, effects similar to those of the centrifugal compressor 10 can be achieved by the hub-side convex portion 132*b* being formed on the hub wall surface 132.

Figure 7:
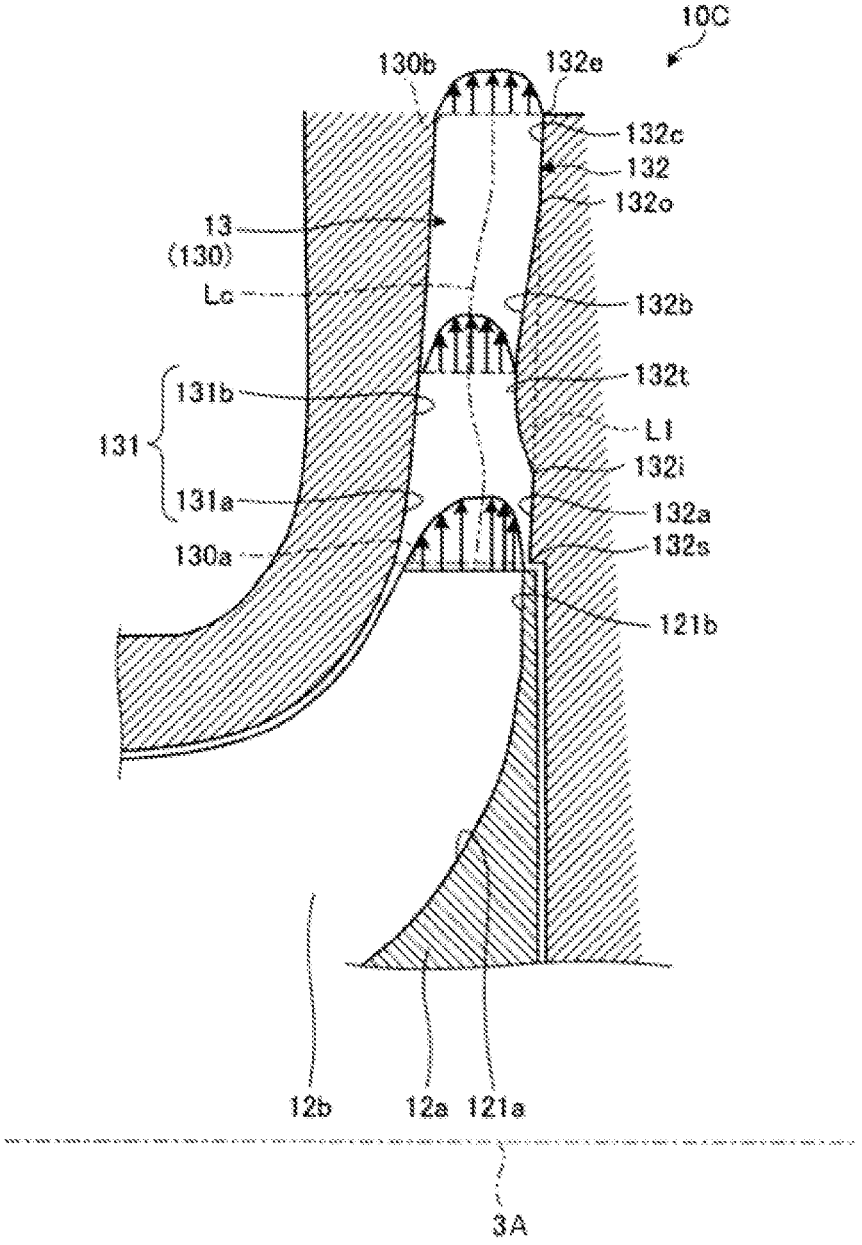
FIG. 7 is a cross-sectional view illustrating a centrifugal compressor according to another modification example of the first embodiment.

FIG. 7 is a cross-sectional view illustrating a centrifugal compressor according to another modification example of the first embodiment. Although only the second linear portion 132*c* of the hub wall surface 132 is inclined radially outward to the axially downstream side in the example that is illustrated in FIG. 6, the first linear portion 132*a* and the hub-side convex portion 132*b* of the hub wall surface 132 may be inclined at the same angle as the second linear portion 132*c* as in a centrifugal compressor 10C illustrated in FIG. 7. In other words, in the centrifugal compressor 10C, the hub wall surface 132 may extend obliquely toward the axially downstream side from the starting end 132*s* toward the terminating end 132*e*. Also in this case, it is preferable that the inclination angle of the linear portion 131*b* of the shroud wall surface 131 and the inclination angle of the hub wall surface 132 are substantially equal to each other and the angles are approximately five degrees to 10 degrees relative to the direction orthogonal to the rotating shaft 3.

In this configuration, the hub wall surface 132 inclined toward the axially downstream side from the starting end 132*s* toward the terminating end 132*e* is capable of smoothly guiding, into the diffuser flow path 130, a flow in which a force toward the axially downstream side remains in the vicinity of the inlet 130*a* of the diffuser flow path 130, that is, the impeller outlet 12*c*. In the present embodiment, the shroud wall surface 131 has the asymptotic portion 131*a* as described above. The shroud wall surface 131 having the asymptotic portion 131*a* is another reason why it is possible to smoothly guide, into the diffuser flow path 130, the flow in which the force toward the axially downstream side remains in the vicinity of the inlet 130*a* of the diffuser flow path 130, that is, the impeller outlet 12*c*. As a result, a pressure loss at the inlet 130*a* of the diffuser flow path 130 can be prevented, the rate of static pressure recovery by the diffuser 13 can be further increased, and the efficiency of the centrifugal compressor 10C and the efficiency of the turbocharger 1 can be further improved.

Second Embodiment

Figure 8:
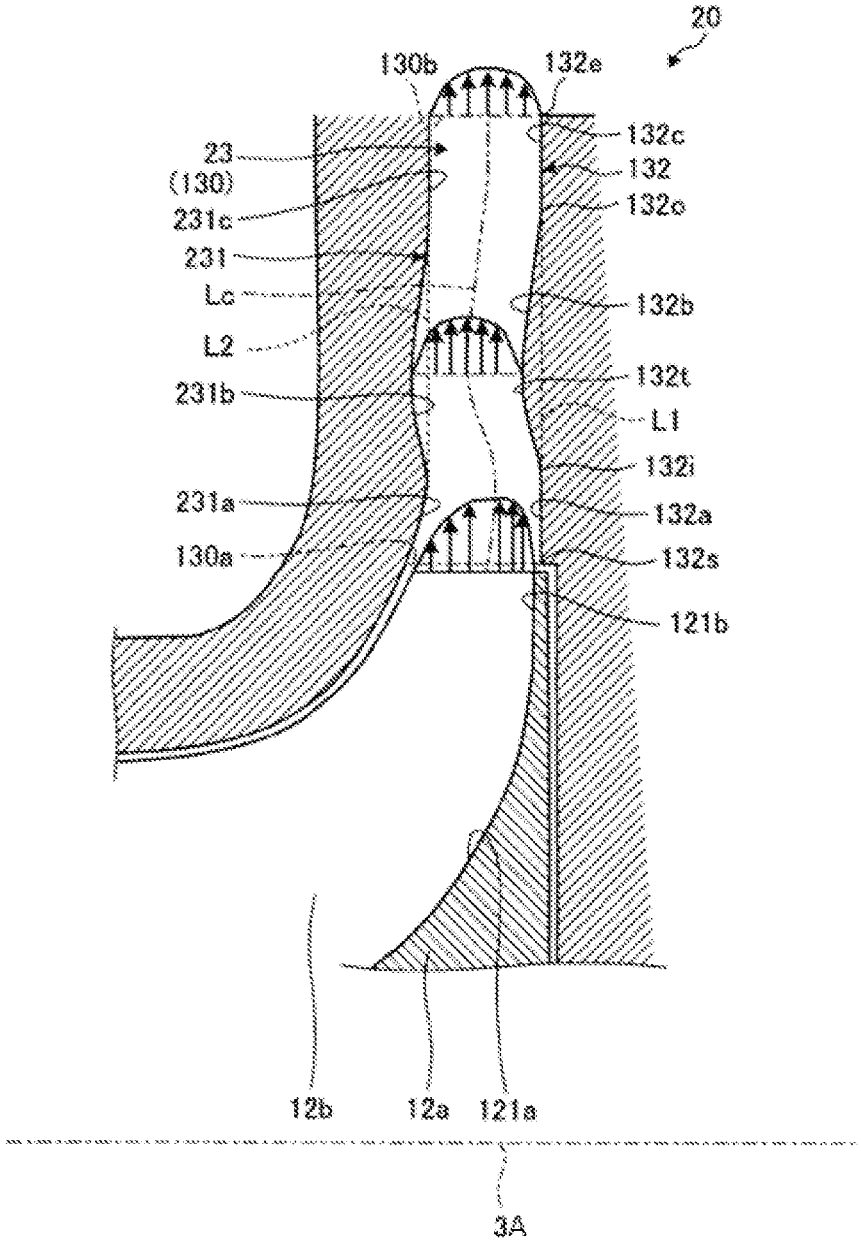
FIG. 8 is a cross-sectional view illustrating a centrifugal compressor according to a second embodiment.

Next, a centrifugal compressor 20 according to a second embodiment will be described. FIG. 8 is a cross-sectional view illustrating the centrifugal compressor according to the second embodiment. The centrifugal compressor 20 according to the second embodiment is provided with a diffuser 23 in place of the diffuser 13 of the centrifugal compressor 10 according to the first embodiment. The diffuser 23 has a shroud wall surface 231 in place of the shroud wall surface 131 of the diffuser 13 of the centrifugal compressor 10 according to the first embodiment. The other configurations of the centrifugal compressor 20 and the diffuser 23 are similar to those of the centrifugal compressor 10 and the diffuser 13, and thus will not be described. It should be noted that the centrifugal compressor 20 according to the second embodiment is also applied to the turbocharger 1 described in the first embodiment.

In the diffuser 23, the shroud wall surface 231 has an asymptotic portion 231*a* asymptotic toward the hub wall surface 132 radially outward from the inlet 130*a* of the diffuser flow path 130, a shroud-side concave portion 231*b* extending radially outward from the asymptotic portion 231*a*, and a linear portion 231*c* extending in the direction orthogonal to the rotating shaft 3 from the shroud-side concave portion 231*b* to the outlet 130*b* of the diffuser flow path 130.

In the second embodiment, the outermost peripheral portion of the asymptotic portion 231*a* of the shroud wall surface 231 and the innermost peripheral portion of the linear portion 231*c* are formed side by side in the axial direction. The shroud-side concave portion 231*b* is a part concave to the side that is opposite to the hub wall surface 132 (left side in FIG. 8) beyond a straight line L2 connecting the outermost peripheral portion of the asymptotic portion 231*a* and the innermost peripheral portion of the linear portion 231*c*. The shroud-side concave portion 231*b* is formed over the entire periphery of the shroud wall surface 231. In the second embodiment, the shroud-side concave portion 231*b* is formed in the shape of a smooth curve that has a curvature continuously changing between the asymptotic portion 231*a* and the linear portion 231*c*. As illustrated in FIG. 8, the shroud-side concave portion 231*b* is provided at a position opposing the hub-side convex portion 132*b*.

In the second embodiment, the shroud-side concave portion 231*b* is formed so as to have a size at which the width of the diffuser flow path 130 becomes constant between the shroud-side concave portion 231*b* and the hub-side convex portion 132*b* as a limit. In other words, in the second embodiment, the shroud-side concave portion 231*b* is concave toward the side that is opposite to the hub wall surface 132 in a shape conforming to the shape of the hub-side convex portion 132*b* with the shroud-side concave portion 231*b* having the same radial starting end as the innermost peripheral portion 132*i* of the hub-side convex portion 132*b* and having the same radial terminating end as the outermost peripheral portion 132*o* of the hub-side convex portion 132*b*.

With this configuration, an excessive decrease in the width of the diffuser flow path 130 can be prevented by the shroud-side concave portion 231*b* even with the hub wall surface 132 provided with the hub-side convex portion 132*b*. Accordingly, it is possible to prevent an excessive increase in the main flow velocity in the diffuser flow path 130 attributable to the provided hub-side convex portion 132*b*. As a result, a pressure loss attributable to wall surface friction can be prevented and adjustment can be performed in a more appropriate manner such that flow deceleration by the diffuser 23 and, in turn, the rate of recovery of the static pressure of the fluid reaches a desired value. Accordingly, the efficiency of the centrifugal compressor 20 and the efficiency of the turbocharger 1 can be further improved as compared with the centrifugal compressor 10 according to the first embodiment.

The shroud-side concave portion 231*b* is formed so as to have a size at which the width of the diffuser flow path 130 becomes constant between the shroud-side concave portion 231*b* and the hub-side convex portion 132*b* as a limit.

With this configuration, it is possible to prevent an excessive increase in the width of the diffuser flow path 130 between the hub-side convex portion 132*b* and the shroud-side concave portion 231*b* and it is possible to prevent the flow from losing uniformity in the diffuser flow path 130. As a result, it becomes possible to more appropriately adjust the rate of recovery of the static pressure of the fluid by the diffuser 23.

In the second embodiment, the shroud-side concave portion 231*b* may not have exactly the same radial starting end as the innermost peripheral portion 132*i* of the hub-side convex portion 132*b* and may not have exactly the same radial terminating end as the outermost peripheral portion 132*o* of the hub-side convex portion 132*b* insofar as the shroud-side concave portion 231*b* opposes the hub-side convex portion 132*b*. In addition, the shroud-side concave portion 231*b* may not be concave toward the side opposite to the hub wall surface 132 in the shape that conforms to the shape of the hub-side convex portion 132*b*. In this case, the shroud-side concave portion 231*b* may not be formed so as to have the size at which the width of the diffuser flow path 130 becomes constant between the shroud-side concave portion 231*b* and the hub-side convex portion 132*b* as a limit.

In the second embodiment, the linear portion 231*c* of the shroud wall surface 231 and the second linear portion 132*c* of the hub wall surface 132 (or the entire hub wall surface 132) may be inclined radially outward to the axially downstream side as in the centrifugal compressor 10B according to the modification example of the first embodiment.

Also in the second embodiment, the shroud wall surface 231 may not have the asymptotic portion 231*a*. In other words, the shroud wall surface 231 may have a linear portion extending radially outward in the direction orthogonal to the rotating shaft 3, the linear portion 231*c*, and the shroud-side concave portion 231*b* concave toward the side opposite to the hub wall surface 132 between the linear portion 231*c* and the linear portion.

Third Embodiment

Figure 9:
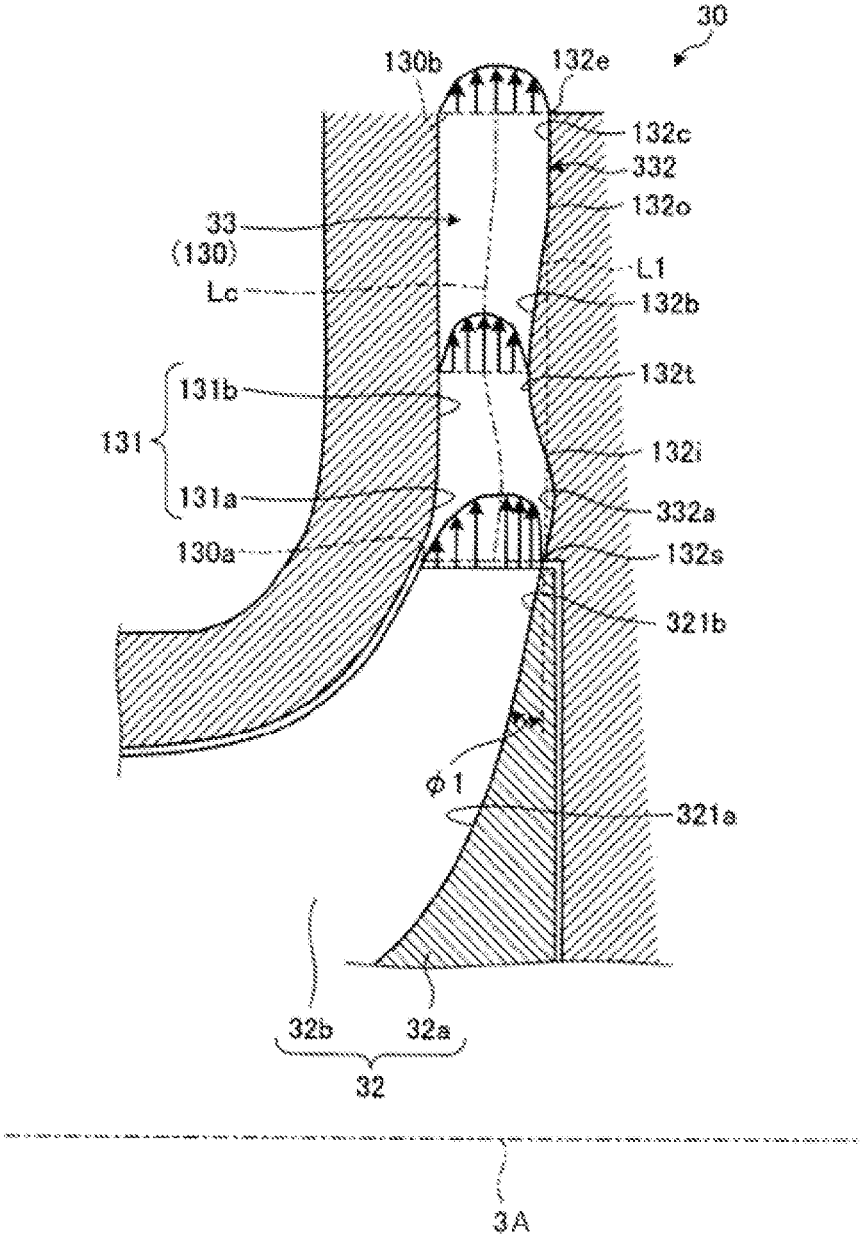
FIG. 9 is a cross-sectional view illustrating a centrifugal compressor according to a third embodiment.

Next, a centrifugal compressor 30 according to a third embodiment will be described. FIG. 9 is a cross-sectional view illustrating the centrifugal compressor according to the third embodiment. The centrifugal compressor 30 according to the third embodiment is provided with an impeller 32 in place of the impeller 12 of the centrifugal compressor 10 according to the first embodiment. In addition, the centrifugal compressor 30 according to the third embodiment is provided with a diffuser 33 in place of the diffuser 13 of the centrifugal compressor 10 according to the first embodiment. The other configurations of the centrifugal compressor 30 are similar to those of the centrifugal compressor 10, and thus will not be described. It should be noted that the centrifugal compressor 30 according to the third embodiment is also applied to the turbocharger 1 described in the first embodiment.

As illustrated in FIG. 9, the impeller 32 has an impeller hub 32*a* rotating integrally with the rotating shaft 3 and a plurality of blades 32*b* attached to the impeller hub 32*a*. The blade 32*b* is attached to the outer peripheral surface of the impeller hub 32*a*. A back plate portion 321*a*, which is a part of the outer peripheral surface and extends radially outward, includes an inclined portion 321*b* extending obliquely toward the axially downstream side and a hub wall surface 332. In the third embodiment, the inclined portion 321*b* is inclined at an inclination angle φ1 relative to the direction orthogonal to the rotating shaft 3 at the impeller outlet 12*c*. Here, the impeller 32 is referred to as a back plate-inclined impeller.

As illustrated in FIG. 9, the diffuser 33 has the hub wall surface 332 in place of the hub wall surface 132 of the diffuser 13. In addition, the hub wall surface 332 has a hub-side concave portion 332*a* in place of the first linear portion 132*a* of the hub wall surface 132. The other configurations of the diffuser 33 and the hub wall surface 332 are similar to those of the diffuser 13 and the hub wall surface 132, and thus will not be described.

In the third embodiment, the hub-side concave portion 332*a* extends radially outward from the inlet 130*a* of the diffuser flow path 130 and is connected to the innermost peripheral portion 132*i* of the hub-side convex portion 132*b*. The hub-side concave portion 332*a* is a part concave toward the side that is opposite to the shroud wall surface 131 relative to the straight line L1 connecting the terminating end 132*e* and the starting end 132*s* of the hub wall surface 332. The hub-side concave portion 332*a* is formed over the entire periphery of the hub wall surface 332. In the third embodiment, the hub-side concave portion 332*a* is formed in the shape of a smooth curve that has a curvature continuously changing between the hub-side convex portion 132*b* and the starting end 132*s* of the hub wall surface 332.

The hub-side concave portion 332*a* is concave toward the side opposite to the shroud wall surface 131 at an inclination angle conforming to the inclination angle φ1 of the back plate portion 321*a* of the impeller hub 32*a*. In other words, in the third embodiment, the part of the hub-side concave portion 332*a* that extends away from the shroud wall surface 131 radially outward from the starting end 132*s* is inclined with respect to the direction orthogonal to the rotating shaft 3 at the angle that is equal to the inclination angle φ1.

In this configuration, the back plate portion 321*a* of the impeller hub 32*a* is inclined at the inclination angle φ1 at the impeller outlet 12*c* and the hub-side concave portion 332*a* formed at an inclination angle conforming to the inclination angle φ1 of the impeller hub 32*a* is capable of smoothly guiding the flow into the diffuser flow path 130 even in a case where the force toward the downstream side in the axial direction of the flow becomes stronger in the vicinity of the inlet 130*a* of the diffuser flow path 130. As a result, a pressure loss at the inlet 130*a* of the diffuser flow path 130 can be prevented, the rate of static pressure recovery by the diffuser 33 can be further increased, and the efficiency of the centrifugal compressor 30 and the efficiency of the turbocharger 1 can be further improved.

It should be noted that the inclination angle of the hub-side concave portion 332*a* may not be exactly the same as the inclination angle φ1 and the inclination angle of the hub-side concave portion 332*a* may be smaller or larger in value than the inclination angle φ1 insofar as a fluid can be smoothly guided into the diffuser flow path 130 from the impeller hub 32*a*.

In the third embodiment, the shroud wall surface 131 has the asymptotic portion 131*a*, which is asymptotic to the hub wall surface 332 side radially outward from the inlet 130*a* of the diffuser flow path 130, as in the first and second embodiments. Accordingly, an excessive increase in the width of the diffuser flow path 130 in the vicinity of the inlet 130*a* can be prevented by the asymptotic portion 131*a* of the shroud wall surface 131 even with the hub-side concave portion 332*a* formed in the hub wall surface 332. As a result, the thickness of the boundary layer of the flow on the shroud wall surface 131 side and the thickness of the boundary layer of the flow on the hub wall surface 332 side can become uniform in the vicinity of the inlet 130*a* of the diffuser flow path 130 and the flow can be pushed out toward the hub wall surface 332 side as a whole. As a result, an increase in the thickness of the boundary layer of the flow on the hub wall surface 332 side can be prevented even in a case where the hub wall surface 332 is provided with the hub-side concave portion 332*a*, and thus it is possible to prevent a reverse flow at the boundary layer of the flow on the hub wall surface 332 side.

It should be noted that the shroud wall surface 131 may not have the asymptotic portion 131*a* in the third embodiment. In other words, the shroud wall surface 131 may have only a linear portion extending radially outward in the direction orthogonal to the rotating shaft 3. In addition, the asymptotic portion 131*a* may be formed in the shape of a convex portion that is closer to the hub wall surface 332 side than in the example illustrated in FIG. 9. Then, it is possible to further prevent the boundary layer of the flow on the hub wall surface 332 side from becoming thick even in a case where the hub wall surface 332 is provided with the hub-side concave portion 332*a*, and thus it is possible to prevent a reverse flow at the boundary layer of the flow on the hub wall surface 332 side.

In the third embodiment, the linear portion 131*b* of the shroud wall surface 131 and the second linear portion 132*c* of the hub wall surface 332 (or the entire hub wall surface 132) may be inclined radially outward to the axially downstream side as in the centrifugal compressor 10B according to the modification example of the first embodiment.

Fourth Embodiment

Figure 10:
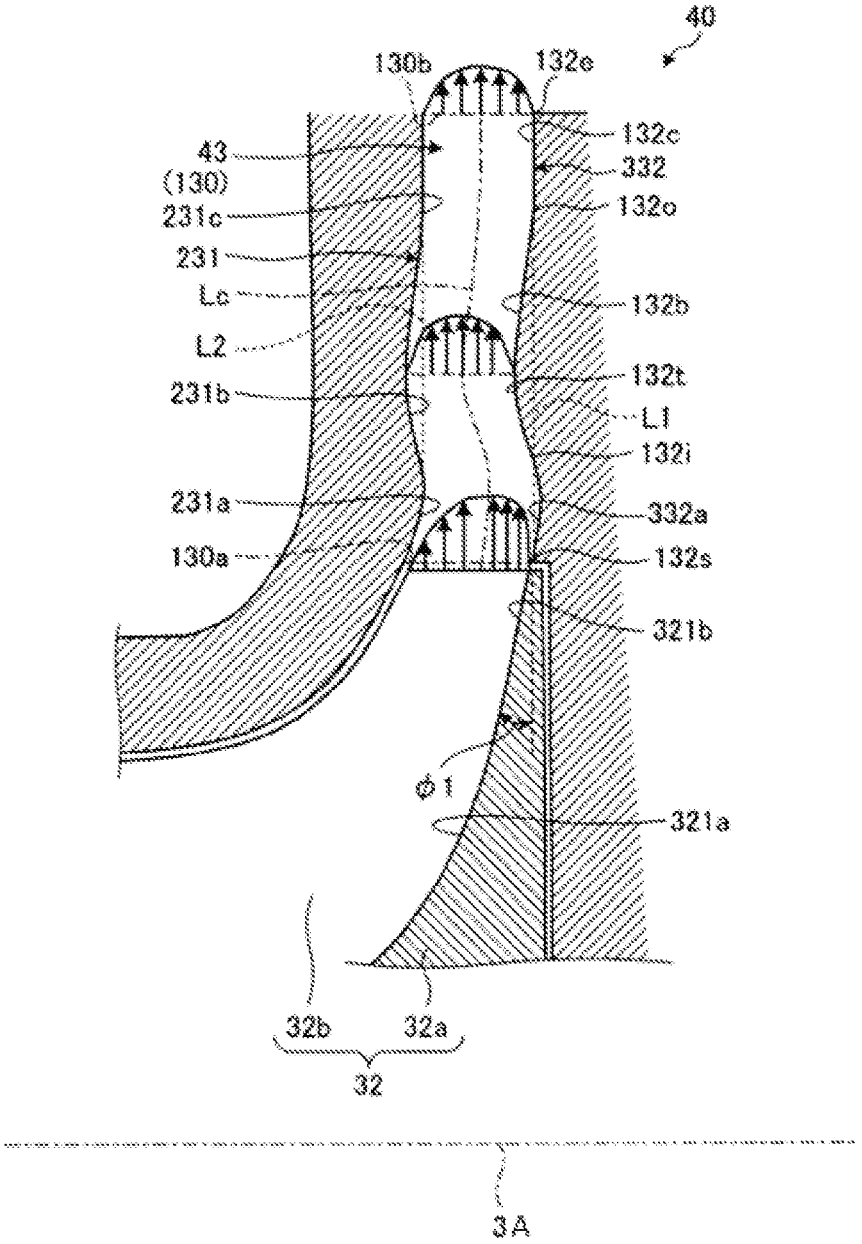
FIG. 10 is a cross-sectional view illustrating a centrifugal compressor according to a fourth embodiment.

Next, a centrifugal compressor 40 according to a fourth embodiment will be described. FIG. 10 is a cross-sectional view illustrating the centrifugal compressor according to the fourth embodiment. The centrifugal compressor 40 according to the fourth embodiment is provided with the impeller 32 of the third embodiment in place of the impeller 12 of the centrifugal compressor 10 according to the first embodiment. In addition, the centrifugal compressor 40 according to the fourth embodiment is provided with a diffuser 43 in place of the diffuser 13 of the centrifugal compressor 10 according to the first embodiment. The other configurations of the centrifugal compressor 40 are similar to those of the centrifugal compressor 10, and thus will not be described. It should be noted that the centrifugal compressor 40 according to the fourth embodiment is also applied to the turbocharger 1 described in the first embodiment.

The diffuser 43 has the shroud wall surface 231 of the diffuser 23 of the second embodiment in place of the shroud wall surface 131 of the diffuser 13 of the first embodiment. In addition, the diffuser 43 has the hub wall surface 332 of the diffuser 33 of the third embodiment in place of the hub wall surface 132 of the diffuser 13 of the first embodiment.

In the centrifugal compressor 40 according to the fourth embodiment, the diffuser 43 has the shroud wall surface 231 of the second embodiment and the hub wall surface 332 of the third embodiment. Accordingly, the centrifugal compressor 40 according to the fourth embodiment is capable of achieving the effects of both the centrifugal compressor 20 according to the second embodiment and the centrifugal compressor 30 according to the third embodiment.

In the fourth embodiment, the linear portion 231*c* of the shroud wall surface 231 and the second linear portion 132*c* of the hub wall surface 332 (or the entire hub wall surface 132) may be inclined radially outward to the axially downstream side as in the centrifugal compressor 10B according to the modification example of the first embodiment.

The shroud wall surface 231 may not have the asymptotic portion 231*a* in the fourth embodiment. In other words, the shroud wall surface 231 may have a linear portion extending radially outward in the direction orthogonal to the rotating shaft 3, the linear portion 231*c*, and the shroud-side concave portion 231*b* concave toward the side opposite to the hub wall surface 332 between the linear portion 231*c* and the linear portion. In addition, the asymptotic portion 231*a* may be formed in the shape of a convex portion that is closer to the hub wall surface 332 side than in the example illustrated in FIG. 10. Then, it is possible to further prevent the boundary layer of the flow on the hub wall surface 332 side from becoming thick even in a case where the hub wall surface 332 is provided with the hub-side concave portion 332*a*, and thus it is possible to prevent a reverse flow at the boundary layer of the flow on the hub wall surface 332 side.

Although the hub-side convex portion 132*b* is formed in the shape of a smooth curve that has a curvature continuously changing between the second linear portion 132*c* and the first linear portion 132*a* or the hub-side concave portion 332*a* in the first to fourth embodiments, the shape of the hub-side convex portion 132*b* is not limited thereto. The hub-side convex portion 132*b* may have, for example, a circular arc shape or a parabolic shape. In addition, the hub-side convex portion 132*b* may include a linear part at a part of the hub-side convex portion 132*b*.

The hub-side convex portion 132*b* may be connected to the first linear portion 132*a* or the hub-side concave portion 332*a* in the shape of a smooth curve or while being refracted. The hub-side convex portion 132*b* may be connected to the second linear portion 132*c* in the shape of a smooth curve or while being refracted. In a case where the hub-side convex portion 132*b* and the second linear portion 132*c* are connected while being refracted, a linear portion extending in the axial direction may be included between the second linear portion 132*c* and the outermost peripheral portion 132*o* of the hub-side convex portion 132*b*.

The hub-side convex portion 132*b* may be formed from the starting end 132*s* of the hub wall surface 132 at the inlet 130*a* of the diffuser flow path 130 or may be formed from the terminating end 132*e* of the hub wall surface 132 at the outlet 130*b* of the diffuser flow path 130. In other words, the innermost peripheral portion 132*i* of the hub-side convex portion 132*b* may coincide with the starting end 132*s* and the outermost peripheral portion 132*o* of the hub-side convex portion 132*b* may coincide with the terminating end 132*e*.

Although the present invention is applied to a vaneless diffuser in the first to fourth embodiments, the present invention may also be applied to a so-called small-chord ratio diffuser in which a vane (blade) is disposed in the range of up to approximately ½ of the radius gap from the inlet 130*a* to the outlet 130*b* in the radial direction from the inlet 130*a* of the diffuser flow path 130. In addition, the present invention may be applied to a so-called vaned diffuser in which a vane (blade) is disposed in the range of approximately 80% to 90% of the radius gap from the inlet 130*a* to the outlet 130*b* in the diffuser flow path 130.

REFERENCE SIGNS LIST

1 Turbocharger
2 Turbine
3 Rotating shaft
10, 10A, 10B, 10C Centrifugal compressor
100A Normal operation point
101, 101A Low flow operation point
103, 103A Surge point
11 Casing
111 Shroud
111*a* Tubular portion
111*b* Disk-shaped portion
112 Hub
12 Impeller
12*a* Impeller hub
121*a* Back plate portion
121*b* Linear portion
12*b* Blade
12*c* Impeller outlet
13 Diffuser
130 Diffuser flow path
130*a* Inlet
130*b* Outlet
131 Shroud wall surface
131*a* Asymptotic portion
131*b* Linear portion
231*b* Shroud-side concave portion
132, 332 Hub wall surface
132*a* First linear portion
132*b* Hub-side convex portion
132*c* Second linear portion
132*e* Terminating end
132*i* Innermost peripheral portion
132*o* Outermost peripheral portion
132*s* Starting end
132*t* Vertex
14 Suction passage
20 Centrifugal compressor
23 Diffuser
231 Shroud wall surface
231*a* Asymptotic portion
231*b* Shroud-side concave portion
231*c* Linear portion
30 Centrifugal compressor
32 Impeller
32*a* Impeller hub
32*b* Blade
321*a* Back plate portion
321*b* Inclined portion
33 Diffuser
332*a* Hub-side concave portion
43 Diffuser
b Width
b1 Inlet width
b2 Outlet width
D Distance
L1, L2 Straight line
Lc Center line
r Radius
r1 Inlet radius
r2 Outlet radius
θ1, θ2 Flow angle
φ1 Inclination angle

The invention claimed is:

1. A centrifugal compressor comprising:

an impeller boosting a fluid by rotation about an axis of a rotating shaft; and.

a diffuser converting a dynamic pressure of the fluid boosted by the impeller into a static pressure, wherein the diffuser has an inlet, an outlet, a shroud wall surface extending in a radial direction of the centrifugal compressor and a hub wall surface extending in the radial direction and opposing the shroud wall surface on a downstream side of a flow in an axial direction of the centrifugal compressor, the diffuser having a gap between the hub wall surface and the shroud wall surface and forming an annular diffuser flow path with the gap, the fluid flowing through the diffuser flow path, a hub-side convex portion is formed over an entire periphery of the hub wall surface, the hub-side convex portion protruding toward the shroud wall surface side relative to a straight line connecting a starting end on an inlet side of the diffuser flow path and a terminating end on an outlet side of the diffuser flow path, the hub-side convex portion is formed so as to have a size at which an annular area as a product of a circumferential length and a width of the diffuser flow path at any radial position is greater than an annular area as a product of a circumferential length and a width of the diffuser flow path at the inlet, the shroud wall surface has a shroud-side concave portion provided so as to oppose the hub-side convex portion and be concave to a side opposite to the hub wall surface, and a vertex of the hub-side convex portion is provided in a range inward in the radial direction from a central portion of the hub-side convex portion in the radial direction.

2. The centrifugal compressor according to claim 1, wherein the vertex of the hub-side convex portion is formed at a radial position 1.05 to 1.4 times a radius from the rotating axis at the inlet of the diffuser flow path.

3. The centrifugal compressor according to claim 2, wherein the hub-side convex portion is provided inside a position in the radial direction, the position having a radius of 0.9 or less times a radius from the rotating axis at the outlet of the diffuser flow path.

4. The centrifugal compressor according to claim 2, wherein the hub-side convex portion has a distance from the straight line to the vertex in the axial direction ranging from 0.1 times to 0.3 times a width of the diffuser flow path at the outlet.

5. The centrifugal compressor according to claim 1, wherein the hub-side convex portion is provided inside a position in the radial direction, the position having a radius of 0.9 or less times a radius from the rotating axis at the outlet of the diffuser flow path.

6. The centrifugal compressor according to claim 5, wherein the hub-side convex portion has a distance from the straight line to the vertex in the axial direction ranging from 0.1 times to 0.3 times a width of the diffuser flow path at the outlet.

7. The centrifugal compressor according to claim 1, wherein the hub-side convex portion has a distance from the straight line to the vertex in the axial direction ranging from 0.1 times to 0.3 times a width of the diffuser flow path at the outlet.

8. The centrifugal compressor according to claim 1, wherein the shroud-side concave portion is formed so as to have a size, as a maximum, at which a width of the diffuser flow path becomes constant in the radial direction between the hub-side convex portion and the shroud-side concave portion.

9. The centrifugal compressor according to claim 1 wherein the impeller has an impeller hub rotating integrally with the rotating shaft and a blade attached to the impeller hub, the impeller hub includes a linear portion extending in a direction orthogonal to the rotating shaft to an impeller outlet, and the hub wall surface forming the diffuser flow path extends obliquely toward the downstream side in the axial direction from the starting end toward the terminating end.

10. The centrifugal compressor according to claim 1, wherein the shroud wall surface has an asymptotic portion that is asymptotic toward the hub wall surface side radially outward from the inlet.

11. A turbocharger comprising:

the centrifugal compressor according to claim 1; and a turbine that is coaxially connected to the centrifugal compressor via the rotating shaft.

12. A centrifugal compressor comprising:

an impeller boosting a fluid by rotation about an axis of a rotating shaft; and a diffuser converting a dynamic pressure of the fluid boosted by the impeller into a static pressure, wherein the diffuser has an inlet, an outlet, a shroud wall surface extending in a radial direction of the centrifugal compressor and a hub wall surface extending in the radial direction and opposing the shroud wall surface on a downstream side of a flow in an axial direction of the centrifugal compressor, the diffuser having a gap between the hub wall surface and the shroud wall surface and forming an annular diffuser flow path with the gap, the fluid flowing through the diffuser flow path, a hub-side convex portion is formed over an entire periphery of the hub wall surface, the hub-side convex portion protruding toward the shroud wall surface side relative to a straight line connecting a starting end on an inlet side of the diffuser flow path and a terminating end on an outlet side of the diffuser flow path, the hub-side convex portion is formed so as to have a size at which an annular area as a product of a circumferential length and a width of the diffuser flow path at any radial position is greater than an annular area as a product of a circumferential length and a width of the diffuser flow path at the inlet, the impeller has an impeller hub rotating integrally with the rotating shaft and a blade attached to the impeller hub, the impeller hub includes an inclined portion extending obliquely toward the downstream side in the axial direction toward the hub wall surface forming the diffuser flow path, and the hub wall surface forming the diffuser flow path has a hub-side concave portion that is concave toward a side opposite to the shroud wall surface and has an inclination angle conforming to an inclination angle of the inclined portion of the impeller hub radially inside the hub-side convex portion.

13. The centrifugal compressor according to claim 12, wherein thea vertex of the hub-side convex portion is provided in a range inward in the radial direction from a central portion of the hub-side convex portion in the radial direction.

14. The centrifugal compressor according to claim 12, wherein a vertex of the hub-side convex portion is formed at a radial position 1.05 to 1.4 times a radius from the rotating axis at the inlet of the diffuser flow path.

15. The centrifugal compressor according to claim 12, wherein the hub-side convex portion is provided inside a position in the radial direction, the position having a radius of 0.9 or less times a radius from the rotating axis at the outlet of the diffuser flow path.

16. The centrifugal compressor according to claim 12, wherein the hub-side convex portion has a distance from the straight line to a vertex in the axial direction ranging from 0.1 times to 0.3 times a width of the diffuser flow path at the outlet.

17. The centrifugal compressor according to claim 12, wherein the shroud wall surface has an asymptotic portion that is asymptotic toward the hub wall surface side radially outward from the inlet.

18. A turbocharger comprising:

the centrifugal compressor according to claim 12; and a turbine that is coaxially connected to the centrifugal compressor via the rotating shaft.

* * * * *